United States Patent [19]

Inoue

[11] Patent Number: 4,974,217

[45] Date of Patent: Nov. 27, 1990

[54] SCALE INDICATOR USED WITH ELECTRONIC SETTING APPARATUS FOR SETTING NUMERICAL VALUES OF PHYSICAL QUANTITIES OR THE LIKE

[75] Inventor: Takeshi Inoue, Takatsuki, Japan

[73] Assignee: Idec Izumi Corporation, Osaka, Japan

[21] Appl. No.: 332,822

[22] Filed: Apr. 4, 1989

[51] Int. Cl.[5] ..... G04F 8/00; G09F 9/00

[52] U.S. Cl. ..... 368/108; 368/185; 368/232; 116/308; 116/DIG. 46

[58] Field of Search ..... 368/107-113, 368/185-187, 223, 228, 232; 116/248.1, 249, 307, 308, DIG. 37, DIG. 46; 200/35 R, 36, 38 R

[56] References Cited

U.S. PATENT DOCUMENTS

| | | | |
|---|---|---|---|
| 2,132,051 | 10/1938 | Schuttenberg | 116/DIG. 46 |
| 2,514,745 | 7/1950 | Dalzell | 116/DIG. 46 |
| 3,713,285 | 1/1973 | Haufe | 368/108 |
| 4,410,774 | 10/1983 | Houpt | 200/14 |
| 4,440,503 | 4/1984 | Arichi et al. | 368/107 |
| 4,547,877 | 10/1985 | Arichi et al. | 368/107 |
| 4,660,992 | 4/1987 | Paul et al. | 368/228 |

*Primary Examiner*—Vit W. Miska

*Attorney, Agent, or Firm*—Pollock, Vande Sande & Priddy

[57] ABSTRACT

A scale indicator used with an electronic setting apparatus, in which at least one of first and second indication sheets has the front surface with a plurality of scale marks and windows, and a third indication sheet rotatable from outside is arranged in 9 space between the first and second indication sheets. At least one of two surfaces of the third indication sheet is printed with characters of a plurality of series of units and numerals representing a plurality of setting scale ranges. The characters of each series of units and numerals are visible from outside through the windows by changing the angle of rotation. A single indicator is thus able to indicate a plurality of scale ranges being available for setting physical quantities and other numerical values.

6 Claims, 3 Drawing Sheets

SCALE INDICATOR USED WITH ELECTRONIC SETTING APPARATUS FOR SETTING NUMERICAL VALUES OF PHYSICAL QUANTITIES OR THE LIKE

BACKGROUND OF THE INVENTION

The present invention relates to a scale indicator arranged on the operation panel of an electronic setting apparatus for numerically setting physical quantities such as time, temperature, or the number of objects and performing a predetermined operation when a set numerical value is reached.

In the technical field of an electronic timer, for example, it is well known that some electronic timers have a plurality of settable ranges including thirty seconds, one minute, ten minutes, thirty minutes, one hour, six hours, etc. any one of which may be voluntarily selected and numerically set by the user intending to use the timers. Such a conventional electronic timer having a plurality of settable ranges any one of which is selectable freely in accordance with the operating conditions is sure to necessitate some timer-setting scale indication plates arranged on the operation panel thereof, which are corresponding to a plurality of ranges, respectively. It is thus necessary to provide as many scale indication plates as the number of ranges settable, out of which the user selects only one scale indication plate to meet his requirement. According to this conventional construction, a plurality of scale indication plates left unselected are inconveniently required to be stored in preparation for the next occasion of use.

Apart from an electronic timer described above for setting time, the similar problems occur in a counter for counting the number of objects, an electronic setting apparatus for setting a temperature, and the like.

SUMMARY OF THE INVENTION

An object of the present invention is to provide a scale indicator used with an electronic setting apparatus having a plurality of ranges for setting a physical quantity or a number of objects to a predetermined numerical value, in which a plurality of scales respectively correspond with a plurality of setting ranges are capable of being made available by a single unit member.

Another object of the present invention is to provide a scale indicator which, in spite of the availability of a plurality of setting ranges with the single unit member, is fabricated in the almost same size as the conventional indication plates with ease and at low cost.

According to the present invention, there is provided a scale indicator used with an electronic setting apparatus, comprising a first indication sheet for indicating scale marks and having a plurality of windows and an opening through which an operation member is adapted to be inserted, a second indication sheet in contact with the first indication sheet and having an opening through which the operation member is adapted to be inserted, and a third indication sheet arranged rotatably in the space between the first and second indication sheets and having at least one surface carrying characters of a plurality of series of units and numerical values representing a plurality of setting ranges and an opening through which the operation member is adapted to be inserted, wherein the third indication sheet may be rotated freely from outside and respective characters of units and numerical values are adapted to be exposed outside through the windows of the first indication sheet by series at required positions.

DESCRIPTION OF THE PREFERRED EMBODIMENTS

Figure 1:
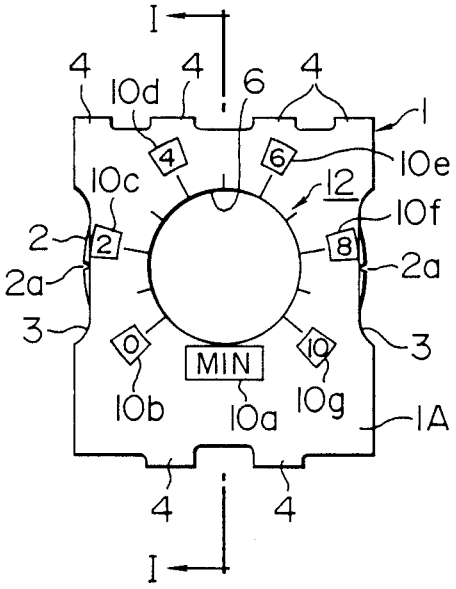
FIG. 1 is a front view of a scale indicator according to the present invention.
Figure 2:
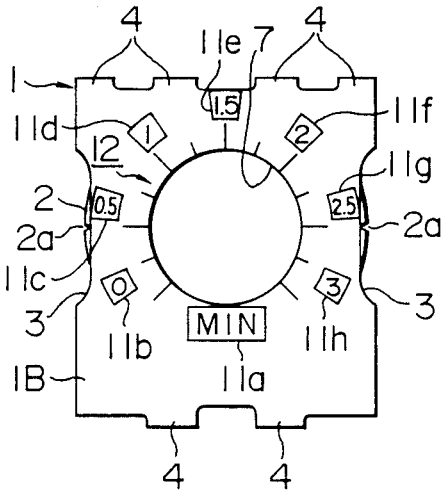
FIG. 2 is a rear view of a scale indicator.
Figure 3:
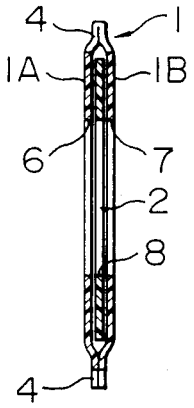
FIG. 3 is a sectional view with an enlarged presentation of thickness taken along the line I-I in FIG. 1.

In FIGS. 1 to 3, reference numeral 1A designates an indication sheet having a front scale indication surface, and numeral 1B an indication sheet having a back scale indication surface. The indication sheets 1A and 1B are fixed (immovable) in ordinary conditions of being used. The indication sheets 1A and 1B according to this embodiment are coupled to each other at the upper edges in the drawings and therefore allowing the indication sheets 1A and 1B to be made up an apparently single sheet 1. The lower edges of the indication sheets 1A and 1B, on the other hand, are attached integrally to each other by adhesive or the like. The indication sheets 1A and 1B need not be made to be a single sheet in the first place, but may be made to be two separated members. The indication sheets 1A and 1B are formed of plastic sheet material, for example. In the scale indicator shown in FIGS. 1 to 3, the integrated indication sheets 1A and 1B are constructed as an outer member of the scale indicator.

The indication sheets 1A and 1B as the outer member are in contact with each other and have a clearance formed therebetween. This clearance is opened outside through the right and left edges of the indication sheets 1A and 1B in FIGS. 1 and 2. A freely rotatable annular indication sheet 2 is arranged in the clearance. The indication sheet 2 is constructed as an inner member of the scale indicator. The indication sheet 2 is also made of a plastic sheet material.

Notches are formed at portions corresponding to the indication sheets 1A and 1B respectively as described later. These notches can make up right and left edge notches 3, 3 as shown in FIGS. 1 and 2 when the indication sheets 1A and 1B are integrally formed as the outer member. As a result, two parts of the outer edge of the indication sheet 2 between the indication sheets 1A and 1B are exposed outside through the notches 3, 3, respectively. A plurality of rectangular protrusions 4 are formed in the upper and lower edges of the integrated indication sheets 1A and 1B as shown in FIG. 1. Four notches 2*a* are formed at angular intervals of 90°, for instance, on the outer edge of the indication sheet 2.

Round openings 6, 7 and 8 of substantially the same diameter are formed at the central part of the indication sheets 1A, 1B and 2. These round openings 6, 7 and 8 are arranged concentrically when the indication sheets 1A, 1B and 2 are assembled into a scale indicator.

The indication sheets 1A and 1B respectively have windows 10*a* to 10*g*, 11*a* to 11*h* at required portions, which are transparent. The characters of units and numerical values printed on the front and back surfaces of the indication sheet 2 are caused to appear through these transparent windows. The outer surfaces of the indication sheets 1A and 1B respectively have scale marks 12 formed in the positions around the round openings 6 and 7. In a plurality of windows 10*a* to 10*g* and 11*a* to 11*h*, the windows 10*a* and 11*a* designate windows used for indicating the characters representing units, and windows 10*b* to 10*g* and 11*b* to 11*h*, formed at positions corresponding to the scale marks 12, designate windows used for indicating the numerical characters representing various setting ranges.

The indication sheets 1A and 1B also may have therein a window for LED indicating an energized state of an electronic setting apparatus and a window for checking a set state of a change-over switch visually from outside. These windows are not shown in the present embodiment.

Figure 4:
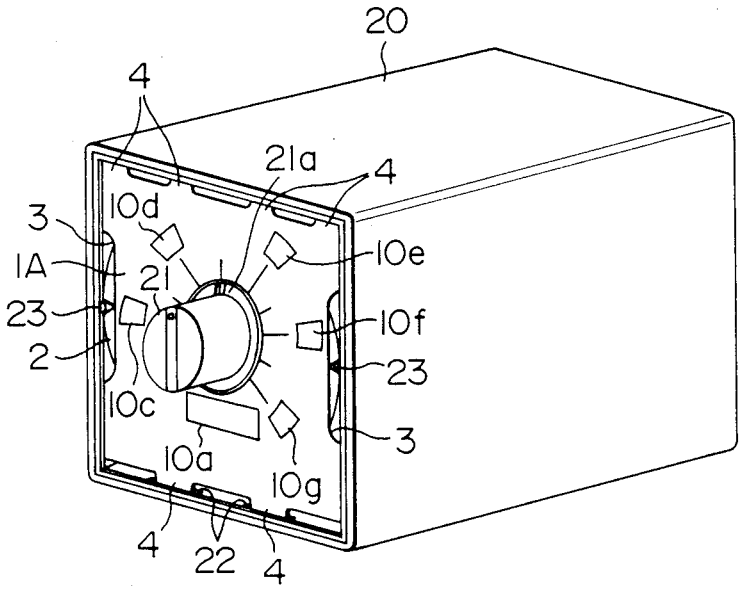
FIG. 4 is a perspective view showing a scale indicator arranged on the operation panel of an electronic setting apparatus.

In FIG. 4, numeral 20 designates an electronic setting apparatus which is an electronic timer according to the present embodiment. An operation panel is arranged on this side of the electronic timer 20. In the shown example, the operation panel is actually located on the back of scale indication sheet 1. The operation panel has a rotatable operation knowb 21 at the central part thereof. The mark 21*a* of the operation knob 21 indicates a set operating position. The scale indicator consisting of the indication sheets 1A, 1B and 2 is mounted on the operation panel of the electronic timer 20. The front scale indication surface of the indication sheet 1A is illustrated in the shown state. Dents 22 are formed in the upper and lower edges of the frame of the operation panel, and protrusions 4 are fitted in the dents 22 thereby to secure the scale indicator on the operation panel. The operation knob 21 is protruded outside through the round openings of the indication sheets 1A, 1B and 2. Two protrusions 23 are formed in the vicinity of the right and left edges on the operation panel and are fitted in the notches 2*a* of the indication sheet 2 respectively. As a result, the freedom of rotation of the indication sheet 2 is restricted. With the scale indicator mounted in this manner, a scale indication surface having the characters of units and numerical values in a specific scale range selected in advance by rotating the indication sheet 2 on the scale indicator which are visible through the transparent windows 10*a* to 10*g* of the indication sheet 1A is formed on the operation panel of the electronic timer 20.

Figure 5:
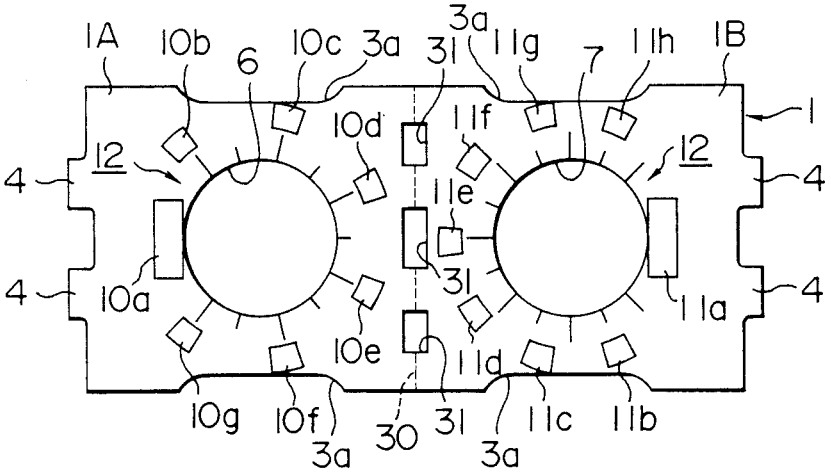
FIG. 5 is a front view of a developed outer sheet member of a scale indicator.

FIG. 5 shows the indication sheets 1A and 1B in open condition as a single sheet member. The identical component parts in FIGS. 1 and 2 are designated by the same reference numerals and will not be described again in detail. Numeral 3*a* designates notches formed at two portions on each of the indication sheets 1A and 1B in order to form the notches 3. In FIG. 5, the dotted line 30 shown as a boundary between the indication sheets 1A and 1B makes up a folding line, with respect of which the indication sheets 1A and 1B are symmetrical to each other, the dotted line 30 being the central line of symmetry. The dotted line 30 has formed thereon rectangular holes 31 at three places thereof. The presence of the holes 31 causes the protrusions 4 at the upper edge to be formed when the indication sheet 1 is folded along the boundary dotted line 30. In this way, a single sheet member is folded along the dotted line 30, and the correspondent parts of interior surfaces at the right and left ends in FIG. 5 and the interior surfaces of the folded parts are respectively adhered to each other except for the round space portion holding the indication sheet 2 rotatable.

Figure 6:
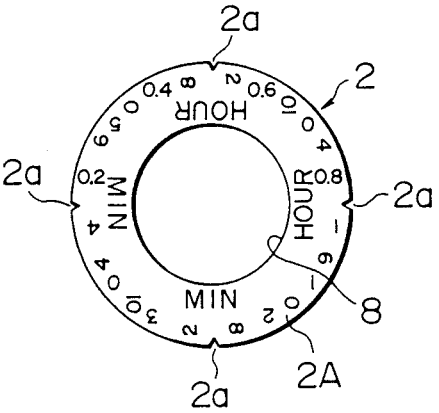
FIG. 6 is a front view of an inner sheet member of a scale indicator.
Figure 7:
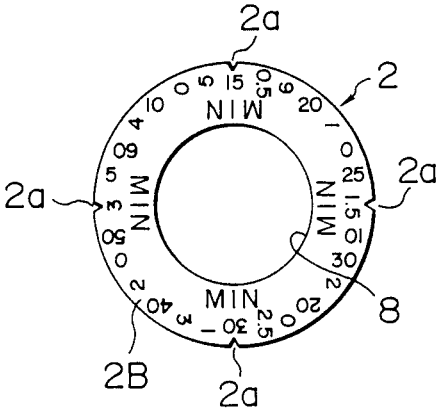
FIG. 7 is a rear view of an inner sheet member.

In FIGS. 6 and 7, the rotatable indication sheet 2 has the round opening 8 of substantially the same size as the round openings 6 and 7 of the indication sheets 1A and 1B at the central part thereof. Four notches 2*a* are formed at angular intervals of 90° along the outer edge of the indication sheet 2. Further, the front and back surfaces 2A and 2B have the characters of four series of units and numerals representing the numerical values of scale in different setting ranges printed thereon respectively. Each of the four series represents a different setting scale range. The characters of units and numerals of a series on the surface 2A of the indication sheet 2 are arranged at positions corresponding to the windows 10*a* and 10*b* to 10*g* of the indication sheet 1A. The characters of units and numerals are printed similarly for four series at angular intervals of 90° on the surface 2A. In similar fashion, the characters of units and numerals belonging to given series are printed on the back surface 2B of the indication sheet 2 at positions corresponding to the windows 11*a* and 11*b* to 11*h* of the indication sheet 1B respectively. Thus four series of units and numerals are printed at intervals of 90° in angle also on the back surface 2B. If the specified notches 2*a*, 2*a* are set at right and left positions respectively with the rotatable indication sheet 2 held by the indication sheets 1A and 1B, characters representing a series of units and numerals are visible through the transparent windows 10*a* to 10*g* and 11*a* to 11*h* as shown in FIGS. 1 and 2 on the respective scale indication surfaces of the indication sheets 1A and 1B. As a result, the scale range of a series is settable on each of the indication sheets 1A and 1B.

Although the embodiment under consideration is a case in which the characters are printed on the both sides of the indication sheet 2 and the indication marks are indicated in both of the indication sheets 1A, 1B, only one of the indication sheets 1A and 1B or one side of the indication sheet 2 may be used without departing from the spirit of the invention.

Figure 8:
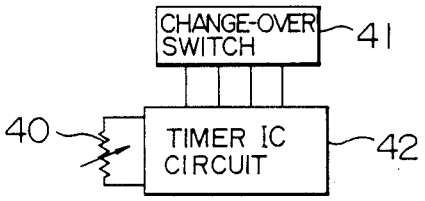
FIG. 8 is a diagram showing an internal circuit configuration of an electronic setting apparatus.

In FIG. 8, the electronic timer 20 is internally configured of a variable resistor 40 adjustable by the operation knob 21, and further comprises a change-over switch 41 arranged on the operation panel on the back of the scale indicator in FIG. 4. The change-over switch 41 is provided, for example, by a four-bit slide switch or a digital switch. The operation knob 21 and the change-over switch 41 are connected to a timer IC circuit 42 in the electronic timer 20.

In the aforementioned construction, the indication sheet 2 is freely rotatable from outside by use of the exposed parts thereof as explained with reference to FIGS. 1 to 3, under the condition that the scale indicator consisting of the indication sheets 1A, 1B and 2 are separated from the electronic timer 20. By rotating the indication sheet 2 by 90° at a time on the front or back thereof, a total of eight setting scale ranges may be used independently with a single scale indicator according to the present invention. Selection of a required scale range is determined in accordance with the timer function of the electronic timer 20 selected by the change-over switch 41.

It will thus be understood from the foregoing description that according to the present invention the indicating function realized by a plurality of required scale indication plates required in the prior arts is realized with a single scale indicator, thereby reducing the number of product types and parts for an improved mass-productivity for manufacturers, while at the same time eliminating the need of storaging a multiplicity of scale indication plates not used by the users.

Further, the scale indicator according to the present invention has such a flexible construction as to be easily mountable on or demountable from the operation panel of the electronic setting apparatus, and for this purpose, the round openings 6, 7 and 8 are formed in a larger diameter than the maximum diameter of the operation knob 21.

I claim:

1. A scale indicator used with an electronic setting apparatus, comprising:

a first indication sheet having scale marks indicated thereon, a plurality of windows formed therein and an opening through which an operation member is inserted;

a second indication sheet in contact with the first indication sheet and having an opening through which said operation member is inserted; and a third indication sheet arranged rotatably in a clearance between said first indication sheet and said second indication sheet, having at least one surface on which a plurality of characters representing a plurality of series of units and numerals for indicating a plurality of scale setting ranges are indicated, and an opening through which the operation member is inserted;

wherein said third indication sheet is adapted to be rotated freely from outside, and the characters of the units and numerals are adapted to be exposed by series at predetermined positions respectively through the windows of the first indication sheet.

2. A scale indicator used with an electronic setting apparatus according to claim 1, wherein said second indication sheet has the front surface thereof indicated with scale marks and formed with a plurality of windows, and the characters of units and numerals of a plurality series representing a plurality of setting ranges respectively indicated on the other surface of said third indication sheet are adapted to be exposed through the windows of said second indication sheet.

3. A scale indicator used with an electronic setting apparatus according to claim 1, wherein a pair of opposite edges of the first and second indication sheets integrated with each other have notches by way of which the outer peripheral edge of said third indication sheet is exposed, thereby rendering the third indication sheet rotatable from outside.

4. A scale indicator used with an electronic setting apparatus according to claim 1, wherein the other pair of opposite edges of the first and second indication sheets integrated with each other are formed with protrusions respectively, which are engaged with dents formed in the mounting surface of the electronic setting apparatus, thereby demountably securing the integrated first and second indication sheets on said mounting surface.

5. A scale indicator used with an electronic setting apparatus according to claim 4, wherein said third indication sheet has the outer peripheral edge thereof formed with at least one notch and said mounting surface is formed with at least one protrusion, so that the notch of the third indication sheet engages the protrusion of the mounting surface when the scale indicator is mounted on the mounting surface.

6. A scale indicator used with an electronic setting apparatus, comprising a first indication sheet and a second indication sheet symmetric with each other with respect to a given line and formed into a single sheet member, each of said sheets having an opening at positions symmetric with respect to said line, each of said openings having therearound different scale marks and windows, said sheets being folded along said line with edges thereof bonded to each other thereby to form an outer indication sheet member including the first and second indication sheets, said indicator further comprising a third indication sheet rotatably arranged in the internal space of the outer indication sheet member and having characters representing a plurality of series of units and numerals printed at such positions as corresponding to the windows around an opening formed corresponding to said openings of said first and second indication sheets.

* * * * *